US010053395B1

(12) United States Patent
Domanico

(10) Patent No.: US 10,053,395 B1
(45) Date of Patent: Aug. 21, 2018

(54) NON-ENERGETIC RESIN-BASED OGIVE SMOKE FILL

(71) Applicant: U.S. Army Edgewood Chemical and Biological Command, Washington, DC (US)

(72) Inventor: Joseph A Domanico, Bel Air, MD (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 186 days.

(21) Appl. No.: 15/080,932

(22) Filed: Mar. 25, 2016

(51) Int. Cl.

| | |
|---|---|
| ***C06B 45/10*** | (2006.01) |
| *C06B 45/04* | (2006.01) |
| *D03D 23/00* | (2006.01) |
| *D03D 43/00* | (2006.01) |

(52) U.S. Cl.
CPC ..... *C06B 45/10* (2013.01)

(58) Field of Classification Search
CPC ..... C06B 45/10
USPC ..... 149/19.4, 17, 109.2, 109.4
See application file for complete search history.

(56) References Cited

U.S. PATENT DOCUMENTS 3,625,855 A * 12/1971 Douda ..... C06B 33/02
149/19.6

* cited by examiner

*Primary Examiner* — James E McDonough
(74) *Attorney, Agent, or Firm* — Ulysses John Biffoni

(57) ABSTRACT

A non-energetic smoke fill composition including a resin, a curing agent, a metallic filler, and a non-metallic filler, wherein the smoke fill composition is configured to be inserted into any of an artillery shell, a mortar cartridge, a gun cartridge, and in general an ogive of a projectile, and wherein the smoke fill composition is configured to be disseminated by a fuze and a supplemental charge to produce a signal visible in both day or night conditions.

15 Claims, 2 Drawing Sheets

NON-ENERGETIC RESIN-BASED OGIVE SMOKE FILL

GOVERNMENT INTEREST

The embodiments described herein may be manufactured, used, and licensed by or for the United States Government.

BACKGROUND

Technical Field

The embodiments herein relate to a smoke fill in a projectile, and more particularly to a non-energetic ogive smoke fill particularly useful in training rounds.

Description of the Related Art

Conventional training ammunition use a high explosive burster and a high explosive fill in the ogive section of the round. For example, the current M1122 training round for use in 155 mm guns uses a high explosive burster and a high explosive fill in the ogive section of the round to produce an impact signal visible both day and night. The projectile body is filled with concrete to allow the round to exhibit a ballistic similitude (same tight path) as the main high explosive round. Its main purpose is for the training of gun operators. However, the high explosive located in the ogive has been identified as a potential cause of malfunctions, some of which have destroyed expensive gun barrels and endangered the lives of soldiers.

The current design of the M1122 artillery projectile contains a multi-option fuze (airburst point detonating, and delay point detonating) and a concrete filled projectile body. The ogive is filled with a specific type of high explosive which is used to provide a signal to an observer of the shell's impact. It must be visible from a specified distance to allow the observer to determine the location and relay that information to others. Because of this high-explosive fill, the procurement, filling, handling, transportation, storage, and use of the round are all carried out as the handling of hazardous material with the associated high costs and dangers. A suitable replacement for the high explosive fill located in the ogive will allow the round to be produced, transported, stored, and loaded as a non-hazardous artillery round until the explosive fuze/burster combination is attached just prior to firing the round during training exercises.

SUMMARY

In view of the foregoing, an embodiment herein provides a non-energetic smoke fill composition comprising: a resin, a curing agent, a metallic filler, and a non-metallic filler, wherein the smoke fill composition is configured to be inserted into any of an artillery shell, a mortar cartridge, a gun cartridge, and, in general, an ogive of a projectile, and wherein the smoke fill composition is configured to be disseminated by a fuze and a supplemental charge, and to produce a detectable signal.

The signal may be visible in both day and night conditions. The smoke fill composition may be configured for use in a 155 mm training round. The smoke fill composition may be inert and is configured to produce inert artillery rounds. The resin may comprise any of: epoxies; polyesters; and polyurethanes. The curing agent may comprise any of: medium viscosity polyamide; a low viscosity cycloaliphatic curative; diacyl peroxides; aliphatic, alicyclic and aromatic amines; imidazoles; polymercaptans; and aromatic, alicyclic and aliphatic anhydrides. The metallic filler may be configured to produce smoke and is in the range of 10% to 80% parts by weight of the composition. The metallic filler may comprise any of: aluminum, magnesium, magnesium-aluminum alloy, titanium, and ferro-titanium alloy. The non-metallic filler may be configured to produce smoke and is in the range of 10% to 80% parts by weight of the composition. The non-metallic filler may comprise any of: boron; carbon; and phosphorus, preferably in finely powdered form. Borosilicate glass spheres (1% to 25%) may be included as non-metallic filler to adjust the cured density of the composition to match the density of the explosive being simulated.

Another embodiment provides a method of consolidating a non-energetic smoke fill composition, the method comprising creating a mixture of resin, a curing agent, powdered metal, and powdered non-metal. The resin may comprise any of epoxies, polyesters, and polyurethanes. The curing agent may comprise any of: medium viscosity polyamide; a low viscosity cycloaliphatic curative; diacyl peroxides; aliphatic, alicyclic and aromatic amines; imidazoles; polymercaptans; and aromatic, alicyclic and aliphatic anhydrides. The powdered metal may be in the range of 10% to 80% parts by weight of the composition. The powdered metal may comprise any of powdered aluminum, powdered magnesium, powdered magnesium-aluminum alloy, powdered titanium, and powdered ferro-titanium alloy. The powdered non-metal may be in the range of 10% to 80% parts by weight of the composition. The powdered non-metallic filler may comprise any of: powdered boron; powdered carbon; and powdered phosphorus, preferably in finely powdered form.

The method may further comprise matching a density of the non-energetic smoke fill composition with an explosive, wherein the non-energetic smoke fill composition is configured to replace the explosive. The matching may comprise adding weight fillers. The weight fillers may comprise high density metals, microballoons, and/or borosilicate glass spheres.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION

The embodiments described herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

Figure 1:
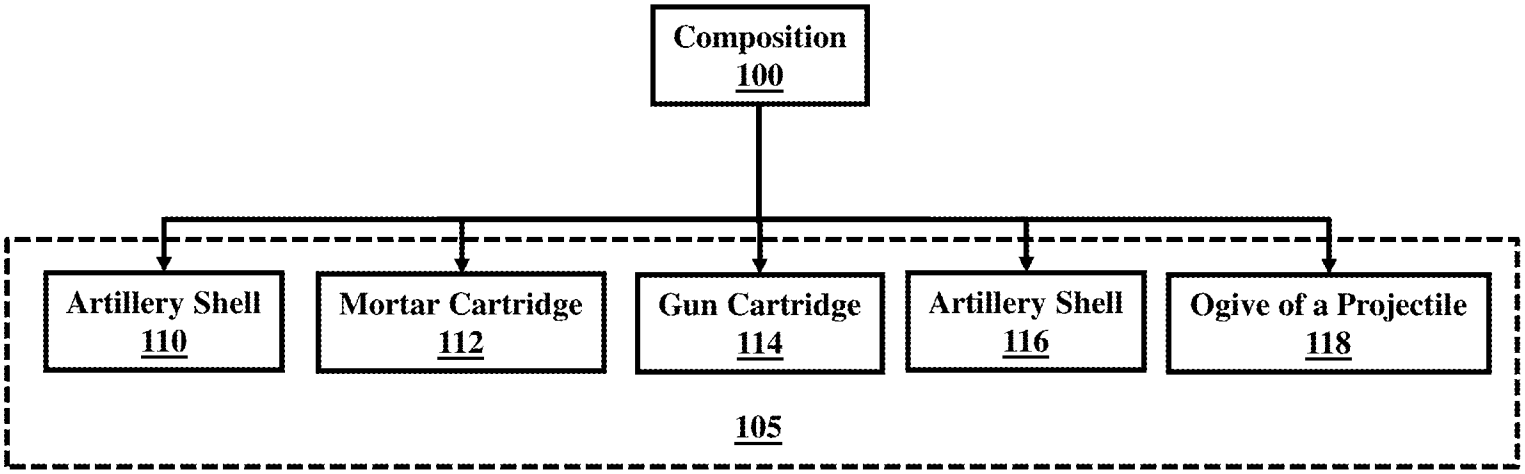
FIG. 1 is a block diagram of using a smoke fill composition according to an embodiment herein.
Figure 2:
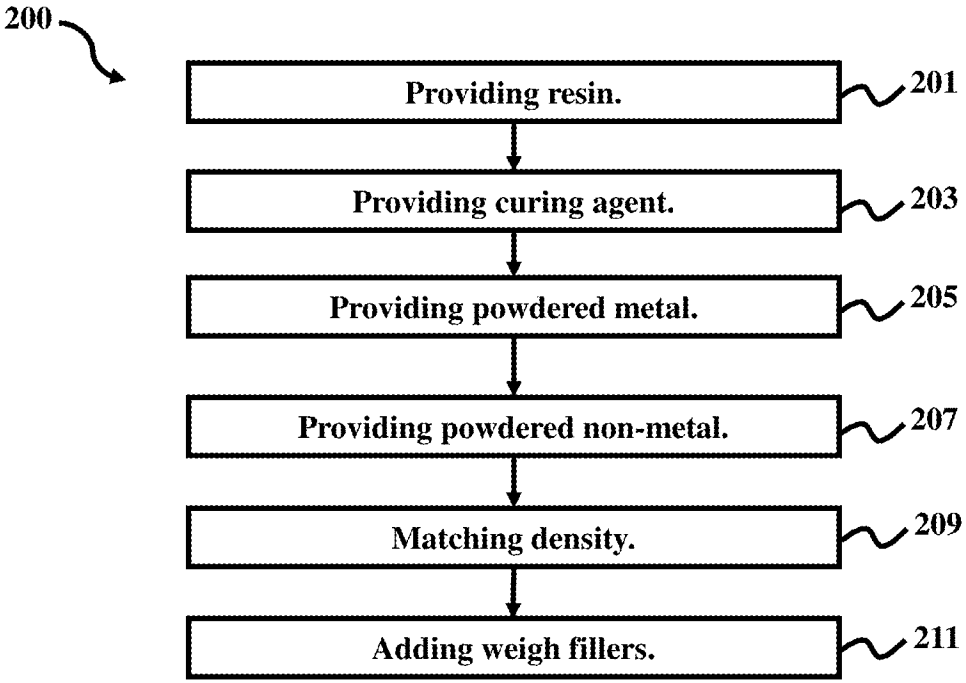
FIG. 2 is a flow diagram illustrating a method according to an embodiment herein.

The embodiments herein provide a non-energetic resin based day/night ogive smoke fill. Referring now to the drawings, and more particularly to FIGS. 1 through 2, where similar reference characters denote corresponding features consistently throughout the figures, there are shown preferred embodiments.

FIG. 1. is a block diagram illustrating utilizing a non-energetic smoke fill composition 100 in canisters 105, which can be implemented in an artillery shell 110, mortar cartridge 112, gun cartridge 114, artillery shell 116, or ogive of a projectile 118, according to an embodiment herein.

In an embodiment herein, the non-energetic smoke fill composition 100 includes resin, a curing agent, a metallic filler, and a non-metallic filler. The smoke fill composition 100 may be configured to produce a signal when used in the ogive of projectile 118 and disseminated by a fuze and a supplemental charge. In an embodiment, the signal is visible both in the day and night. In an exemplary embodiment, the smoke fill composition 100 may be used in a 155 mm training round.

In an embodiment herein, the smoke fill composition 100 is inert, and is configured to produce inert artillery rounds for training of gun crews and forward observers. In an embodiment herein, the resin includes any of epoxies, polyesters, and polyurethanes. The curing agent may comprise any of: medium viscosity polyamide; a low viscosity cycloaliphatic curative; diacyl peroxides; aliphatic, alicyclic and aromatic amines; imidazoles; polymercaptans; and aromatic, alicyclic and aliphatic anhydrides. The metallic filler in composition 100 may be configured to produce smoke and may be in the range of 10% to 80% parts by weight. The metallic filler may include an of aluminum, magnesium, magnesium-aluminum alloy, titanium, and ferro-titanium alloy. The non-metallic filler may be configured to produce smoke and is in the range of 10% to 80% parts by weight. The non-metallic filler may comprise any of: boron; carbon; and phosphorus, preferably in finely powdered form. Borosilicate glass spheres (1% to 25%) may be included as non-metallic filler to adjust the cured density of the composition to match the density of the explosive being simulated.

In an embodiment herein, the resin-based smoke fill composition 100 is a blend of metallic and non-metallic fuels and additives to a multiple component resin which forms a solid inert block within the ogive. The replacement of the hazardous fill with an inert one that meets the existing performance criteria, allows the safe production, transportation, and use of the existing artillery shell 110 at a substantially reduced cost in fabrication, transportation, and storage. The composition can be produced by standard resin casting production equipment with minimal or no change to the existing process. The component materials are less expensive to purchase, store, and handle in the production of the finished composition. The day and night signature of the smoke fill composition 100 is sufficient to be a viable replacement for the existing high explosive fill.

In an embodiment herein, the high explosive fill (e.g. in the ogive of the M1122 artillery round), which may be expensive, is replaced with a non-energetic mixture of solid fuels in a castable, curable resin matrix.

An embodiment herein provides a day/night marking smoke fill composition 100 which utilizes a combination of metallic and non-metallic fuels suspended in a two component, hardening resin matrix. The resin may be blended with both specific fillers and a curative, and cast into the appropriate container. Once hardened, it can be safely machined using standard drills to form a cavity to accept an explosive burster.

An embodiment herein allows the artillery shell 110 to be loaded, shipped, transported, and stored as a completely inert item as opposed to one using a secondary high explosive as the smoke/marker producing agent. The reduction in associated costs by the substitution of an explosive compound with this inert smoke producing resin matrix is substantial. All hazards associated with high explosives and items containing high explosives are also eliminated. The safety-related hazards are removed from workers, drivers, and storage personnel.

In an embodiment herein, the resin type can be varied, and includes the use of several resin types (such as epoxies, polyesters, polyurethanes, etc.) and curatives (such as a medium viscosity polyamide or a low viscosity cycloaliphatic curative). In embodiments, the percent by weight of the component chemicals and fillers may vary.

An embodiment herein provides a design for the use of inert resin-based day/night smoke fill composition 100 in direct fire gun cartridges 114, mortar cartridges 112, and artillery shells 110. In an exemplary embodiment, the resin-based inert smoke composition 100 has application for use in 155 mm artillery shells as gunner/spotter training cartridges. The flash and smoke produced by the explosive dissemination of the inert fill may be used to train both gunners in the handling, fuzing, and firing of ammunition with a minimal hazard from malfunctions, as well as the training of artillery impact spotters required to observe and report the location of the artillery round's impact.

The resin casting technique can also be utilized in filling the empty void in a (60 mm, 81 mm, 120 mm) mortar cartridge 112 ogive as well as any direct or indirect fire round using a fuze with a detonation output.

In an embodiment herein, the reduced toxicity also plays a role in the upkeep of the training ranges. With the majority of the resin matrix including an oxide producing component, the potential for ground water contamination is nearly eliminated. The majority of oxides are not water soluble and will not penetrate the upper layer of soil and contaminate the groundwater supply.

In addition, the presence of a "dud" round on the training range contains only the small amount of explosive contained in the fuze and booster cup. The secondary charge containing several pounds of high explosive is eliminated in this design. The recovery, handling, and final disposition of a dud round using embodiments herein is an order of magnitude safer than previous training round designs.

An embodiment herein provides a non-energetic fill composition 100 which can closely imitate both the day and night signature of the existing round (upon impact) using a fraction of the high explosive in the burster and completely replacing the high explosive fill used in the ogive. In an exemplary embodiment, the potential for the destruction of the gun barrel and the possible harm to the soldiers in the vicinity of the gun are effectively eliminated.

There are several other aspects for the use of the smoke fill composition 100 of the embodiments herein for the ogive well past the initial safety concerns for the gun and crew performing the actual firing. The handling of the fill of the embodiments herein involves handling a non-hazardous substance which allows the manufacture of the round to be performed with much less safety risk. In addition, the finished round can be shipped and stored as containing no explosives, allowing it to be shipped and stored along with other inert items at zero risk during transportation and storage. The finished resin fill has a much reduced cost from the existing fill.

FIG. 2, with reference to FIG. 1, is a flow diagram illustrating a method 200 of consolidating the smoke fill composition 100. Method 200 includes creating a mixture by combining various components including providing resin at step 201, providing a curing agent at step 203, providing powdered metal at step 205, and providing powdered non-metal at step 207. In an embodiment the resin includes any of epoxies, polyester, and polyurethane. In an embodiment the curing agent may comprise any of: medium viscosity polyamide; a low viscosity cycloaliphatic curative; diacyl peroxides; aliphatic, alicyclic and aromatic amines; imidazoles; polymercaptans; and aromatic, alicyclic and aliphatic anhydrides. In an embodiment, the powdered metal is in the range of 10% to 80% parts by weight. The powdered metal may include any of powdered aluminum, powdered magnesium, powdered magnesium-aluminum alloy, powdered titanium, and powdered ferro-titanium alloy. In an embodiment, the powdered non-metal is in the range of 10% to 80% parts by weight. The powdered non-metallic filler may comprise any of: powdered boron; powdered carbon; and powdered phosphorus, preferably in finely powdered form.

Method 200 may include matching density of the non-energetic smoke fill composition with an explosive at step 209. In an embodiment, the non-energetic smoke fill composition is configured to replace the explosive. The matching may include providing weigh fillers at step 211. In an embodiment, the weigh fillers include high density metals. In an embodiment, the weigh fillers include microballoons.

Referring to FIG. 1, an embodiment provides an inert resin-based day/night smoke fill composition 100 for use in replacing high explosive in an ogive for an artillery round 110 or a projectile 118 used for the training of gun crews and forward observers. By replacement of the high explosive in the shell's ogive, a completely inert projectile 118 can be manufactured, transported, and stored as non-hazardous material. The reduced toxicity of the smoke fill composition 100 is a bonus in the maintenance of a safe and low-toxicity training range. Smoke components include a majority of non-water soluble products which remain on the soil surface with a low possibility of groundwater contamination. The density of the smoke fill composition 100 can be varied to accurately match the density of the explosive it is designed to replace. The smoke fill composition 100 can be used in any of artillery shell 110, mortar cartridge 112, gun cartridge 114, artillery shell 116, and ogive of a projectile 118, allowing a training round to have a ballistic similitude (same flight path/characteristics) when compared to the wartime round containing a high explosive payload.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A non-energetic smoke fill composition, comprising:
a resin;
a curing agent;
a metallic filler; and
a non-metallic filler, wherein said non-metallic filler comprises any of powdered boron, powdered carbon, and powdered phosphorus and is in the range of 10% to 80% parts by weight:
and;
wherein said smoke fill composition is configured to be disseminated by a fuze and a supplemental charge to produce a signal.

2. The composition of claim 1, wherein said signal is visible in both day and night conditions.

3. The composition of claim 1, wherein said smoke fill composition is configured for use in a 155 mm training round.

4. The composition of claim 1, wherein said resin comprises any of epoxies, polyesters, and polyurethanes.

5. The composition of claim 1, wherein said smoke fill composition is inert.

6. The composition of claim 1, wherein said metallic filler is configured to produce smoke and is in the range of 10% to 80% parts by weight.

7. The composition of claim 6, wherein said metallic filler comprises any of powdered aluminum, powdered magnesium, powdered magnesium-aluminum alloy, powdered titanium, and powdered ferro-titanium alloy.

8. The composition of claim 1, wherein said curing agent comprises any of: medium viscosity polyamide; a low viscosity cycloaliphatic curative; diacyl peroxides; aliphatic, alicyclic and aromatic amines; imidazoles; polymercaptans; and aromatic, alicyclic and aliphatic anhydrides.

9. The composition of claim 1, further comprising weight fillers, said weight fillers selected from high density metals, microballoons, and borosilicate glass spheres.

10. The composition of claim 1, wherein said smoke fill composition is configured to be inserted into any of an artillery round, a mortar cartridge, a gun cartridge, an artillery shell, and an ogive of a projectile.

11. The composition of claim 10, wherein said artillery round, mortar cartridge, gun cartridge, artillery shell, and ogive of as projectile are training rounds configured to have ballistic similitude with a wartime round.

12. The composition of claim 1, wherein a density of said smoke fill composition matches a density of an explosive, and wherein said smoke fill composition is configured to replace said explosive.

13. The composition of claim 1, wherein said smoke fill composition forms a solid inert block.

14. The composition of claim 1, wherein said smoke fill composition can be manufactured, transported, and stored as a non-hazardous material.

15. The composition of claim 1, wherein said smoke fill composition has a reduced toxicity when compared to high explosive materials.

* * * * *